US009061880B2

(12) United States Patent
Paxman

(10) Patent No.: US 9,061,880 B2
(45) Date of Patent: Jun. 23, 2015

(54) LIQUID COOLING APPARATUS AND METHOD THEREFOR

(76) Inventor: Neil Eric Paxman, Holmfirth (GB)

( * ) Notice: Subject to any disclaimer, the term of this patent is extended or adjusted under 35 U.S.C. 154(b) by 1442 days.

(21) Appl. No.: 12/672,433

(22) PCT Filed: Aug. 4, 2008

(86) PCT No.: PCT/GB2008/002639

§ 371 (c)(1),
(2), (4) Date: Mar. 14, 2012

(87) PCT Pub. No.: WO2009/019457

PCT Pub. Date: Feb. 12, 2009

(65) Prior Publication Data

US 2012/0180977 A1 Jul. 19, 2012

(30) Foreign Application Priority Data

Aug. 6, 2007 (GB) ..... 0715252.3

(51) Int. Cl.

| | |
|---|---|
| ***F25D 17/02*** | (2006.01) |
| ***B67D 1/08*** | (2006.01) |
| ***F25D 31/00*** | (2006.01) |
| ***F28D 7/00*** | (2006.01) |
| ***F28D 7/16*** | (2006.01) |
| ***F28F 27/00*** | (2006.01) |

(52) U.S. Cl.

CPC ..... *B67D 1/0857* (2013.01); *B67D 1/0898* (2013.01); *F25D 31/002* (2013.01); *F28D 7/0066* (2013.01); *F28D 7/16* (2013.01); *F28F 27/00* (2013.01)

(58) Field of Classification Search

CPC ..... F25D 31/002; F25D 23/126; F17C 9/00; Y02E 60/142

USPC ..... 62/98, 389, 390, 45.1, 50.1; 165/104.11

See application file for complete search history.

(56) References Cited

U.S. PATENT DOCUMENTS

| | | | | |
|---|---|---|---|---|
| 2,203,365 | A | 6/1940 | Rice | |
| 2,682,160 | A * | 6/1954 | Kromer | 62/65 |
| 3,257,818 | A * | 6/1966 | Papapanu | 62/98 |
| 5,497,629 | A * | 3/1996 | Rafalovich et al. | 62/98 |
| 5,535,600 | A * | 7/1996 | Mills | 62/390 |

FOREIGN PATENT DOCUMENTS

| | | |
|---|---|---|
| GB | 2090920 | 7/1982 |
| GB | 2346679 | 8/2000 |

OTHER PUBLICATIONS

International Search Report for PCT/GB2008/002639, Jun. 19, 2009, 5 pages.

* cited by examiner

*Primary Examiner* — Melvin Jones
(74) *Attorney, Agent, or Firm* — Reising Ethington P.C.

(57) ABSTRACT

A method of cooling a mixture, the mixture comprising a liquid having a gas dissolved therein, the method comprising the steps of providing the mixture along an input mixture line (3); splitting the mixture from the input mixture line into a plurality of heat exchange tubes (6); flowing a heat exchange fluid over the outside of the heat exchange tubes to cool the mixture; re-combining the mixture into an output mixture line (5); characterized in that the temperature of the heat exchange fluid is arranged such that the temperature of the mixture at the point of recombination in the output mixture line is at or below the solution temperature of the gas in the liquid.

40 Claims, 7 Drawing Sheets

LIQUID COOLING APPARATUS AND METHOD THEREFOR

The present invention relates to a method for cooling a mixture comprising a liquid having a gas dissolved therein and also an apparatus for cooling such a mixture. The present invention also relates to an apparatus for cooling a liquid.

There are some applications where it is required to cool a mixture of a liquid and a gas at a high mixture flow rate. One particular application is in the drinks industry where lagers or beers are chilled prior to serving. The large or beer is typically chilled whilst in the drinks line between the cellar and the tap on the bar. This is usually performed by means of a chilled python line wrapped around the drinks line.

It is currently fashionable to serve extra cold lagers or beers. Such lagers or beers require extra 'top-up' chilling by a heat exchange apparatus located beneath the bar before the lager or beer is served.

It is desired to serve the extra cold beverage at a high flow rate to minimise the time taken to serve customers. A tap on a bar will typically serve a pint of lager or beer in around 10 to 20 seconds (20-40 seconds for Guinness). Times longer than this are not preferred.

This extra top up cooling is typically performed by flowing the beverage along a high thermal conductivity heat exchange tube and flowing a cold heat exchange fluid over the outside of the tube. The tube must be of a relatively large diameter so that the high flow rate can be maintained. This results in poor heat exchange between the beverage and heat exchange fluid. The heat exchange tube must therefore be long so that the required temperature drop can be achieved. This can be inconvenient beneath a bar where space is at a premium.

The required length of the heat exchange tube can be reduced by lowering the temperature of the heat exchange fluid. The use of very low temperature fluids can however be hazardous in the workplace.

The present invention seeks to overcome the drawbacks of the prior art.

Accordingly, in a first aspect, the present invention provides a method of cooling a mixture, the mixture comprising a liquid having a gas dissolved therein, the method comprising the steps of providing the mixture along an input mixture line;

splitting the mixture from the input mixture line into a plurality of heat exchange tubes;

flowing a heat exchange fluid over the outside of the heat exchange tubes to cool the mixture;

re-combining the mixture into an output mixture line;

characterised in that the temperature of the heat exchange fluid is arranged such that the temperature of the mixture at the point of recombination in the output mixture line is at or below the solution temperature of the gas in the liquid.

By splitting the mixture into a plurality of heat exchange tubes the heat exchange between the mixture and the heat exchange fluid can be improved reducing the length of the heat exchange apparatus.

The method can further comprise the step of providing the cooled mixture to a dispensing means for dispensing the cooled mixture at a dispensing rate.

The method can further comprising the step of warming the mixture in the output mixture line.

The heat exchange tubes can be spiral.

The liquid can be a beverage, preferably an alcoholic beverage.

The liquid can be a beer or lager.

The mixture can be recombined at a temperature less than 4° C., preferably less than 2° C.

The method can further comprise the step of pre-cooling the mixture before providing the mixture to the heat exchange tubes.

The step of flowing a heat exchange fluid over the outside of the heat exchange tubes can comprise measuring the flow rate of the mixture through the heat exchange tubes; and, flowing the heat exchange fluid over the heat exchange tubes when the flow rate exceeds a predetermined value.

Preferably, the heat exchange tubes are arranged in a heat exchange jacket through which the heat exchange fluid flows; and, the step of flowing the heat exchange fluid over the outside of the heat exchange tubes comprises the step of withdrawing the heat exchange fluid from the heat exchange jacket when the flow rate is at or below a predetermined value.

Preferably, the step of measuring the flow rate of the mixture comprises determining if the dispensing means is in an open or closed state.

In a further aspect of the invention there is provided an apparatus for cooling a mixture comprising a liquid having a gas dissolved therein, the apparatus comprising a heat exchanger comprising an input mixture port, an output mixture port and a plurality of heat exchange tubes extending therebetween;

a heat exchange jacket surrounding the heat exchange tubes and having input and output ports; and, cooling means adapted to flow a heat exchange fluid into the input port, over the heat exchange tubes and out the output port to cool the mixture within the heat exchange tubes;

The cooling means can be adapted to flow the heat exchange fluid at a temperature sufficiently low that the temperature of the mixture at the output mixture port is at or below the solution temperature of the gas in the liquid.

Preferably, the apparatus further comprises a dispensing means, preferably a tap, for dispensing the cooled mixture at a dispensing rate.

The heat exchange tubes can be spirals.

Preferably, the heat exchange tubes are connected to the input and output mixture ports by laser welding.

The cooling means can comprise a volume containing pre-cooled heat exchange fluid.

The cooling means can comprise a heat exchange pump connect between input and output port and adapted to circulate heat exchange fluid therebetween.

The apparatus can further comprise a flow rate detector for detecting the rate of flow of the mixture in at least one heat exchange tube, the flow rate detector being in communication with the heat exchange pump.

The heat exchange pump can be adapted to provide heat exchange fluid to the heat exchange jacket only when the flow rate of the mixture in the at least one tube is above a reference level.

The heat exchange pump can be adapted to withdraw the heat exchange fluid from the heat exchange jacket when the flow rate of the mixture is below a reference level.

The apparatus can further comprise a mixture source connected to the mixture input port by an input mixture line.

The apparatus can further comprise a pre-cooling means for cooling the mixture before providing it to the input mixture port.

The pre-cooling means can comprise a chilled volume.

The pre-cooling means can comprise a python line wrapped around the input mixture line.

Preferably, the heat pump pumps heat exchange fluid through the python line and then through the heat exchange jacket.

The liquid of the mixture can be a beverage, preferably an alcoholic beverage, more preferably a lager or a beer.

In a further aspect of the invention there is provided an apparatus for cooling a liquid comprising

- a heat exchanger comprising an input liquid port, an output liquid port and at least one heat exchange tube extending therebetween;
- a heat exchange jacket surrounding the at least one heat exchange tube having input and output ports;
- a heat exchange pump connected between input and output ports and adapted to circulate heat exchange fluid therebetween;
- a flow rate detector for detecting the rate of flow of liquid in the at least one heat exchange tube, the flow rate detector being in communication with the heat exchange pump;
- the heat exchange pump being adapted to provide heat exchange fluid to the heat exchange jacket only when the flow rate of the liquid in the at least one heat exchange tube is above a reference level.

The reference level can be zero.

The heat exchange pump can be adapted to withdraw heat exchange fluid from the heat exchange jacket when the flow rate drops below the reference level.

The flow rate detector means can comprise a flow rate meter.

The flow rate detector can be in communication with a tap, the tap being connected to the liquid output port for dispensing the liquid.

Preferably, the tap communicates its on or off state to the heat exchange pump.

The apparatus can further comprise a liquid source connected to the input liquid port.

The temperature of the heat exchange fluid can be lower than the freezing temperature of the liquid.

The liquid can be an alcoholic beverage, preferably a spirit or a vodka.

The liquid can be a beer or lager.

The heat exchange apparatus can comprise a plurality of heat exchange tubes.

Alternatively, the heat exchange apparatus comprises a single heat exchange tube.

The heat exchange tubes can be spiral.

The present invention will now be described by way of example only and not in any limitative sense with reference to the accompanying drawings in which FIG. 1 shows a method according to the invention in schematic form;

Figure 1:
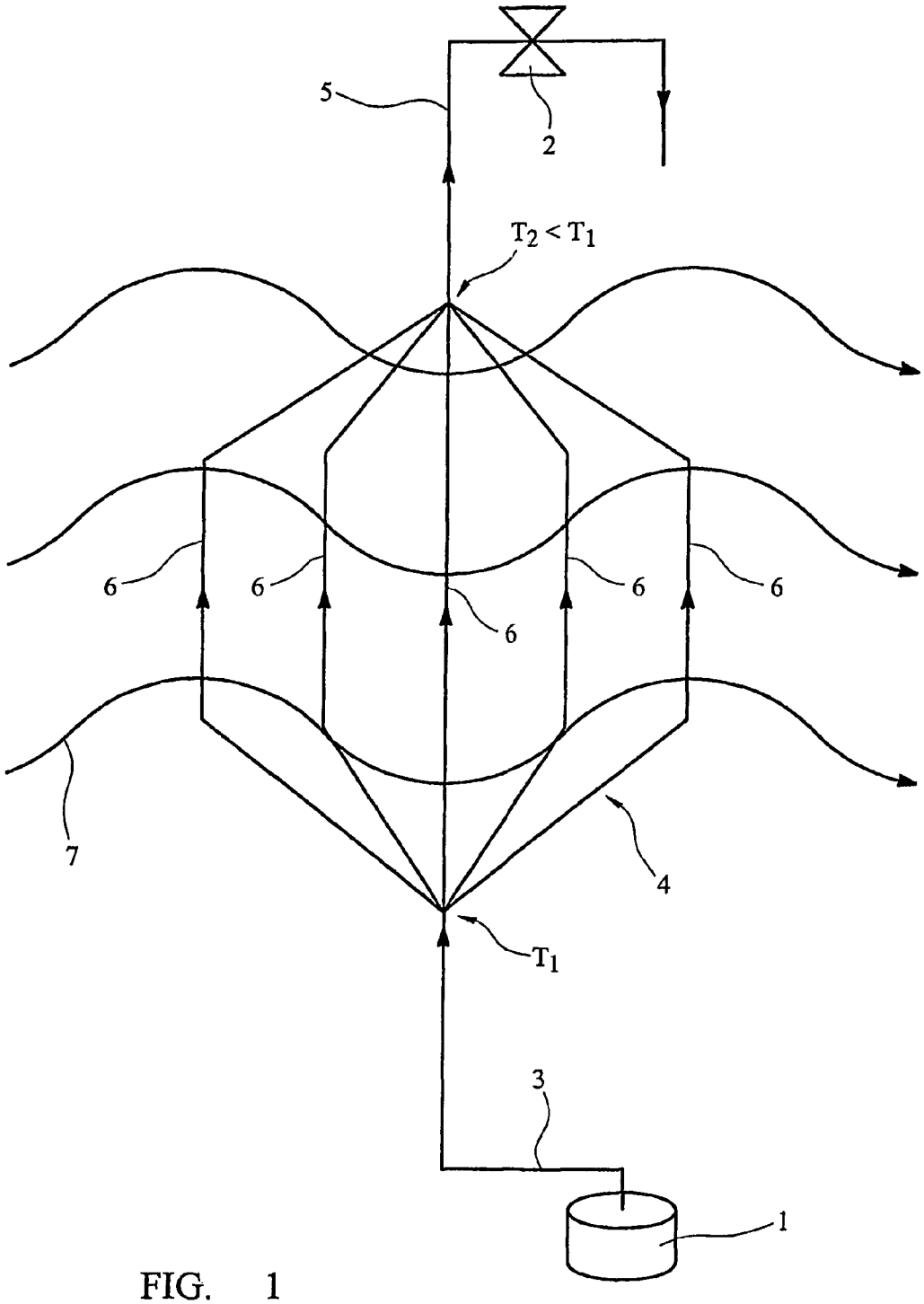

Shown in FIG. 1 is a method for cooling a mixture comprising a liquid having a gas dissolved therein according to the invention. The method is described with reference to cooling of a lager having carbon dioxide dissolved therein. The method is however applicable to other liquid/gas mixtures, in particular when the liquid is a beverage such as an alcoholic beverage, preferably a beer. The gas can be nitrogen.

The lager is stored in a barrel 1, typically in a beer cellar. The barrel 1 is in fluid communication with a tap 2 on the bar counter (not shown). When the tap 2 is opened the lager flows along an input mixture line 3 to a heat exchanger 4 wherein it is chilled and then from the heat exchanger 4 along an output mixture line 5 to the tap 2 where it is served.

Within the heat exchanger 4 the lager is split into a plurality of heat exchange tubes 6. The lager flows along the tubes 6, and then recombines into the output mixture line 5. A heat exchange fluid 7 flows over the heat exchange tubes 6 cooling the lager.

A well known problem within the drinks industry is that of separation of the carbon dioxide from the lager whilst serving. This is referred to as 'break out'. If breaking out occurs the tap 2 will not dispense a liquid but a foam. Breaking out would be expected to occur when the lager in the heat exchange tubes 6 is recombined in the output mixture line 5. The method of the current invention however overcomes this problem by ensuring that the temperature of the lager at the point of recombination is at or less than the solution temperature of the carbon dioxide in the lager.

It may be the case that temperature of the lager at the recombination points is lower than the desired serving temperature. If so the lager can be allowed to warm slightly before serving.

As a typical example for a lager/$CO_2$ mixture temperatures at the recombination point of less than 4° C. are preferred.

Figure 2:
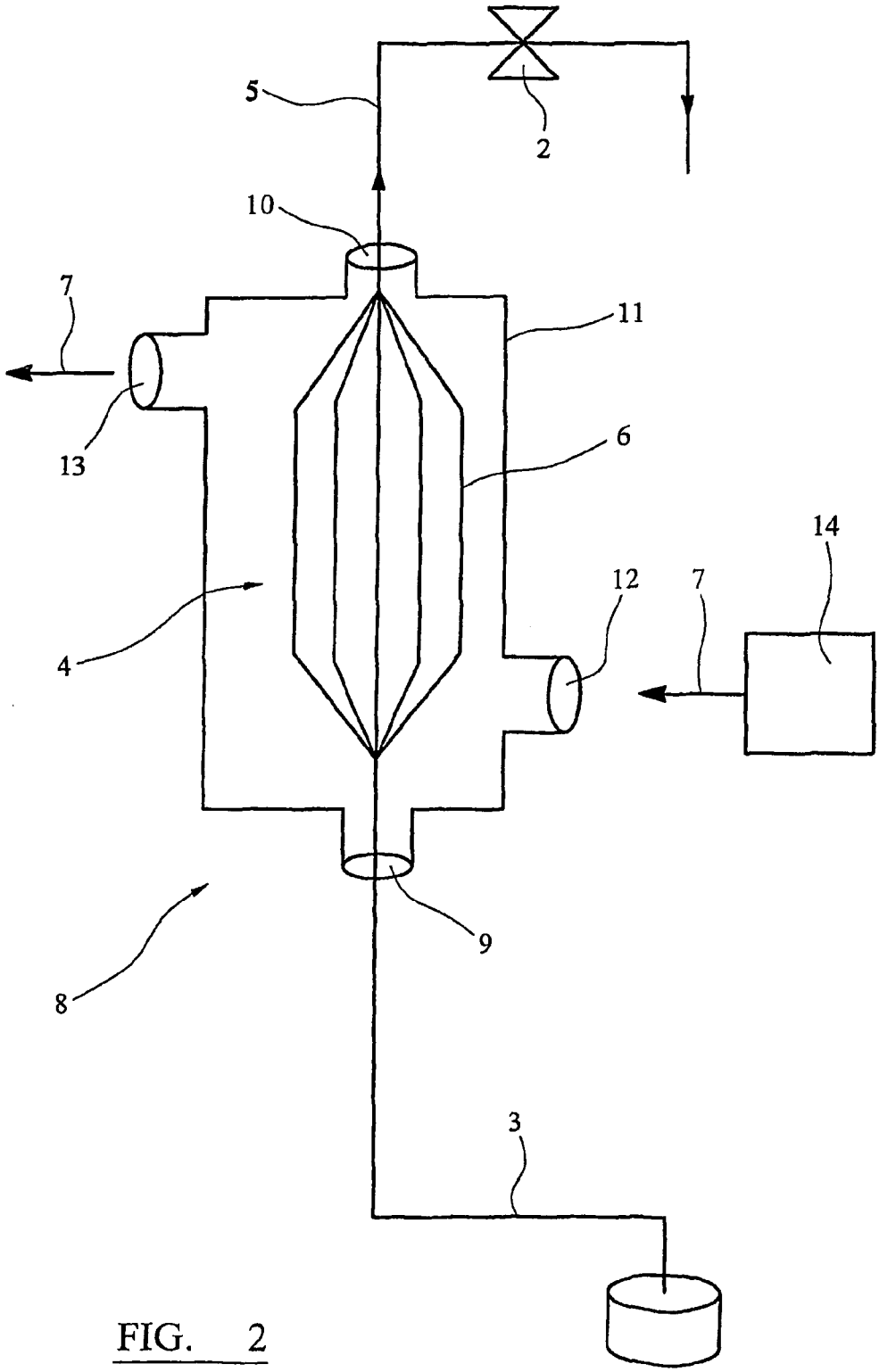
FIG. 2 shows a first embodiment of an apparatus according to the invention.

Shown in FIG. 2 is an apparatus 8 for performing the method according to the invention. The apparatus 8 comprises a heat exchanger 4. The heat exchanger 4 comprises an input mixture port 9, an output mixture port 10 and a plurality of heat exchange tubes 6 extending therebetween. The diameter of the tubes 6 is typically less than the diameter of the input and output ports 9,10. In this embodiment the heat exchange tubes 6 are substantially straight although other shapes such as curved or spirals are possible.

A heat exchange jacket 11 surrounds the heat exchanger 4 as shown. The heat exchange jacket 11 comprises input and output ports 12,13. The ports 12,13 are arranged such that fluid which enters the input port 12 flows over the heat exchange tubes 6 to the output port 13. The input port 12 is connected to a cooling means 14 which flows cooled heat exchange fluid 7 over the heat exchange tubes 6. In this embodiment the cooling means 14 comprises a chilled volume comprising chilled heat exchange fluid 7. After exiting the heat exchange jacket 11 the heat exchange fluid 7 becomes waste or is used in other cooling applications beneath the bar.

The input mixture port 9 is connected to a barrel 1 by the input mixture line 3. The barrel 1 contains a mixture of a lager having carbon dioxide dissolved therein.

The output mixture port 10 is connected to a dispensing means comprising a tap 2 for dispensing the mixture.

In this embodiment the temperature of the heat exchange fluid is around 0.5-2 degrees Centigrade. Colder temperatures (of the order −4 degrees Centigrade) can be achieved with Glycol or Brine With such a heat exchange fluid 7 the temperature of the recombination point can be reduced below zero degrees Centigrade.

Figure 3:
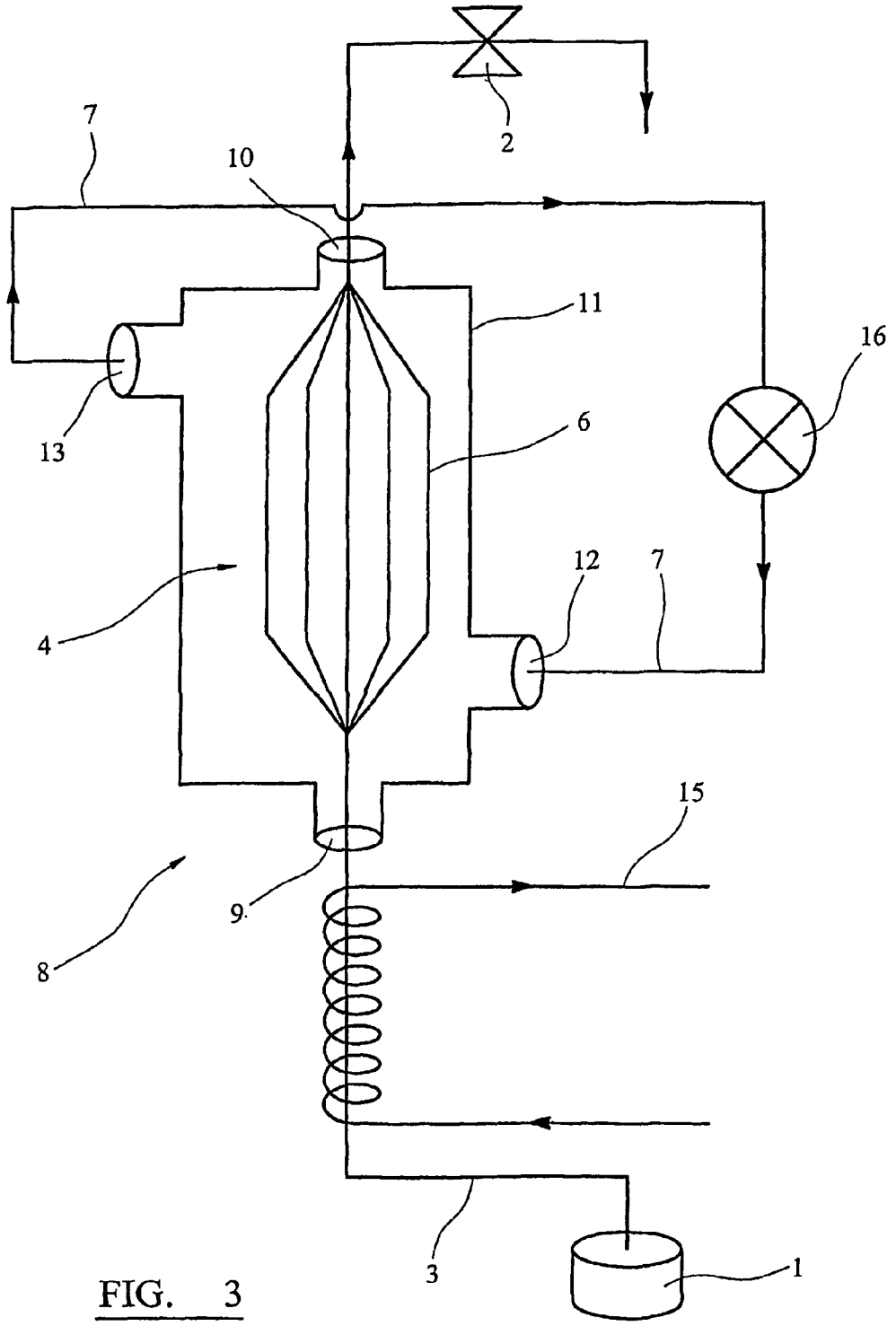
FIG. 3 shows a second embodiment of an apparatus according to the invention.

Shown in FIG. 3 is an alternative embodiment 8 of the invention. In this embodiment a python line 15 is wrapped around the mixture input line 3 to pre-cool the mixture before it reaches the input mixture port 9. The python line 15 is connected to an external source of chilled fluid, typically around 0.5-2 degrees Centigrade. In this embodiment the cooling means 14 comprises a heat exchange pump 16 connected between input and output ports 12,13. The heat exchange pump 16 cools the heat exchange fluid 7 and circulates it between input and output ports 12,13 over the heat exchange tubes 6.

Figure 4:
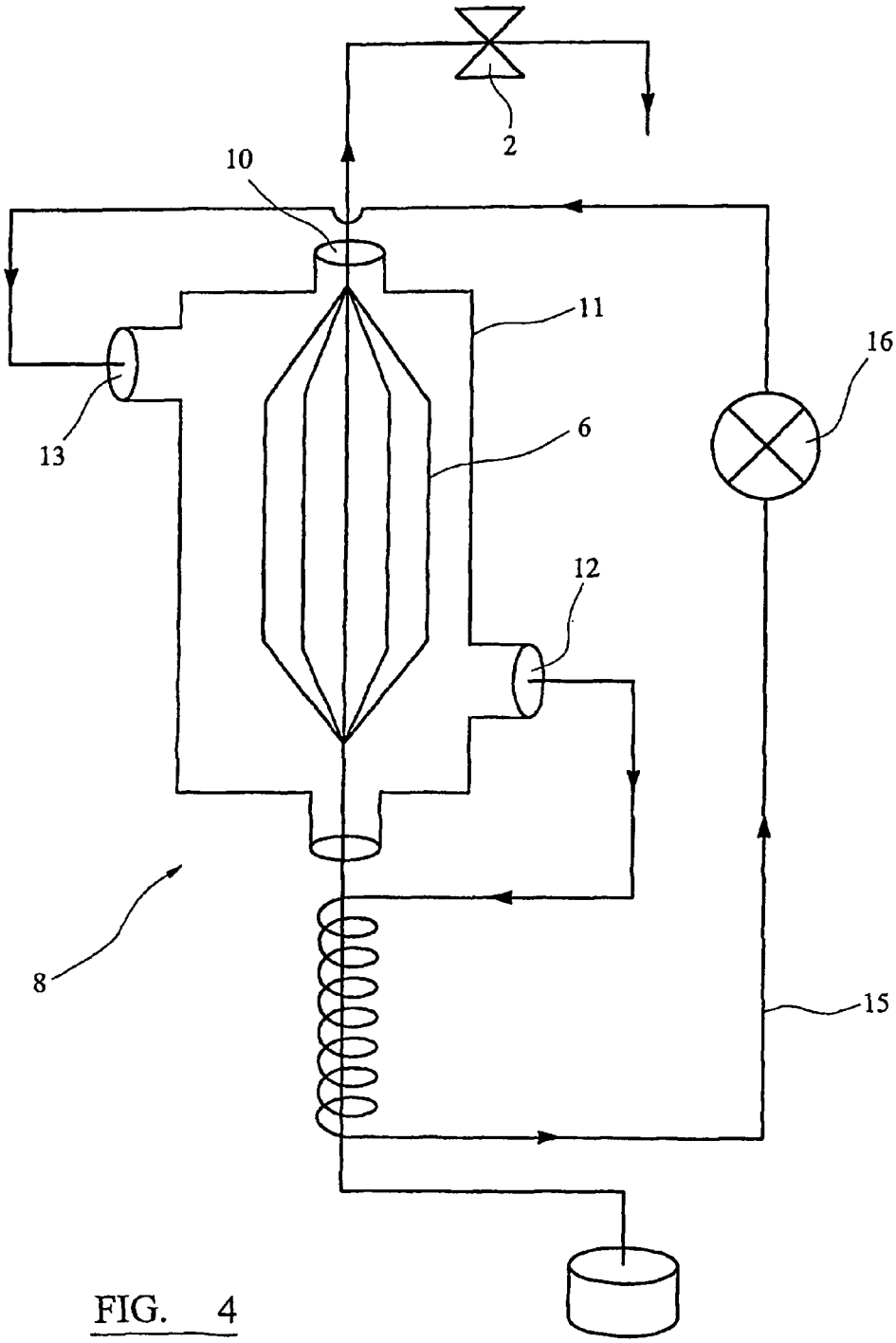
FIG. 4 shows a third embodiment of an apparatus according to the invention.

Shown in FIG. 4 is a further embodiment of the invention 8. This embodiment is similar to that of FIG. 3 except the python line 15 is connected to the heat exchange pump 16. The heat exchange fluid 7 is therefore used both to pre-cool the mixture and to cool the mixture in the heat exchange tubes 6.

The recombination temperature depends upon the mixture. For a lager or beer the recombination temperature is less than 4 degrees Centigrade, preferably less than 2 degrees Centigrade.

Figure 5:
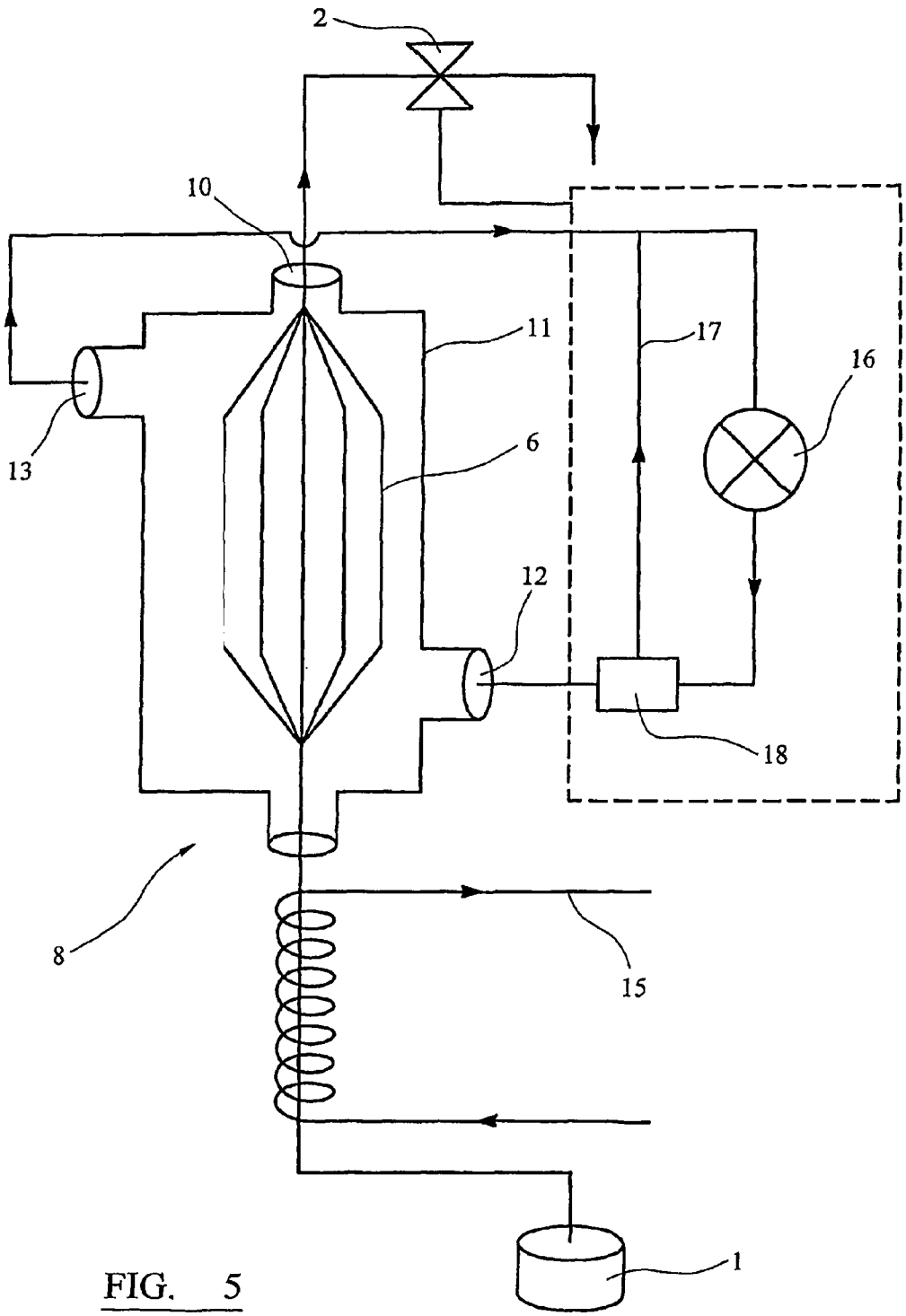
FIG. 5 shows a fourth embodiment of an apparatus according to the invention.

Shown in FIG. 5 is a further embodiment of an apparatus 8 according to the invention. This embodiment is similar to that of FIG. 3 except the tap 2 is in communication with the heat exchange pump 16 by means of a flow rate detector. The heat exchange pump 16 comprises a bypass line 17 and a fluid switch 18 to switch the direction of flow of the heat exchange fluid 7 from the input port 9 into the bypass line 17.

When the tap 2 is opened this is signalled to the heat exchange pump 16. The pump 16 flows the heat exchange fluid 7 through the heat exchange jacket 11 and back to the pump 16. When the tap 2 is closed this again is signalled to the heat exchange pump 16. The fluid switch 18 is changed such that the heat exchange fluid 7 now flows down the bypass line 17 and back to the pump 16, bypassing the heat exchange jacket 11. The small amount of heat exchange fluid with the heat exchange jacket 11 is drawn out of the jacket 11 by the pump 16. This prevents the mixture from being chilled whilst standing in the heat exchange tubes 6 between servings.

When the tap 2 is opened this is again communicated to the heat exchange pump 16. The fluid switch 18 is again changed and the heat exchange fluid 7 resumes flow through the heat exchange jacket 11.

In the above embodiment the flow rate detector informs the heat exchange pump 16 when the mixture flow rate is zero (tap closed) and not zero (tap open). The heat exchange pump 16 only provides heat exchange fluid 7 to the heat exchange jacket 11 when the flow rate is above a reference level (which in this case is zero). In an alternative embodiment (not shown) the apparatus 8 comprises an alternative flow rate detector which provides a more detailed measure of the flow rate than zero or non-zero. In this embodiment the reference level can be sent at a value other than zero. The heat exchange pump 16 runs continuously. In an alternative embodiment the rate at which the heat exchange pump 16 flows fluid 7 over the heat exchange tubes 6 increases with the measured flow rate. The heat exchange pump 16 may switch off when the measured flow rate is zero.

In an alternative embodiment of the invention the heat exchange pump 16 does not remove the residual amount of heat exchange fluid 7 from the heat exchange jacket 11 when the mixture flow rate drops below the reference level. In this embodiment the residual heat exchange fluid 7 and mixture in the heat exchange tubes 6 come into temperature equilibrium when the mixture is standing in the heat exchange tubes 6 between servings.

In all of the above embodiments the temperature of the heat exchange fluid 7 is sufficiently low that the temperature of the mixture at the recombination point is below the solution temperature of the gas in the liquid. In a preferred embodiment the temperature of the heat exchange fluid 7 is below the freezing point of the liquid in the mixture. This enables the length of the heat exchanger 4 to be further reduced. In such an embodiment the heat exchange pump 16 must withdraw the heat exchange fluid 7 from the jacket 11 when the mixture flow rate drops below a reference level to prevent the mixture from freezing in the heat exchange tubes 6.

Figure 6:
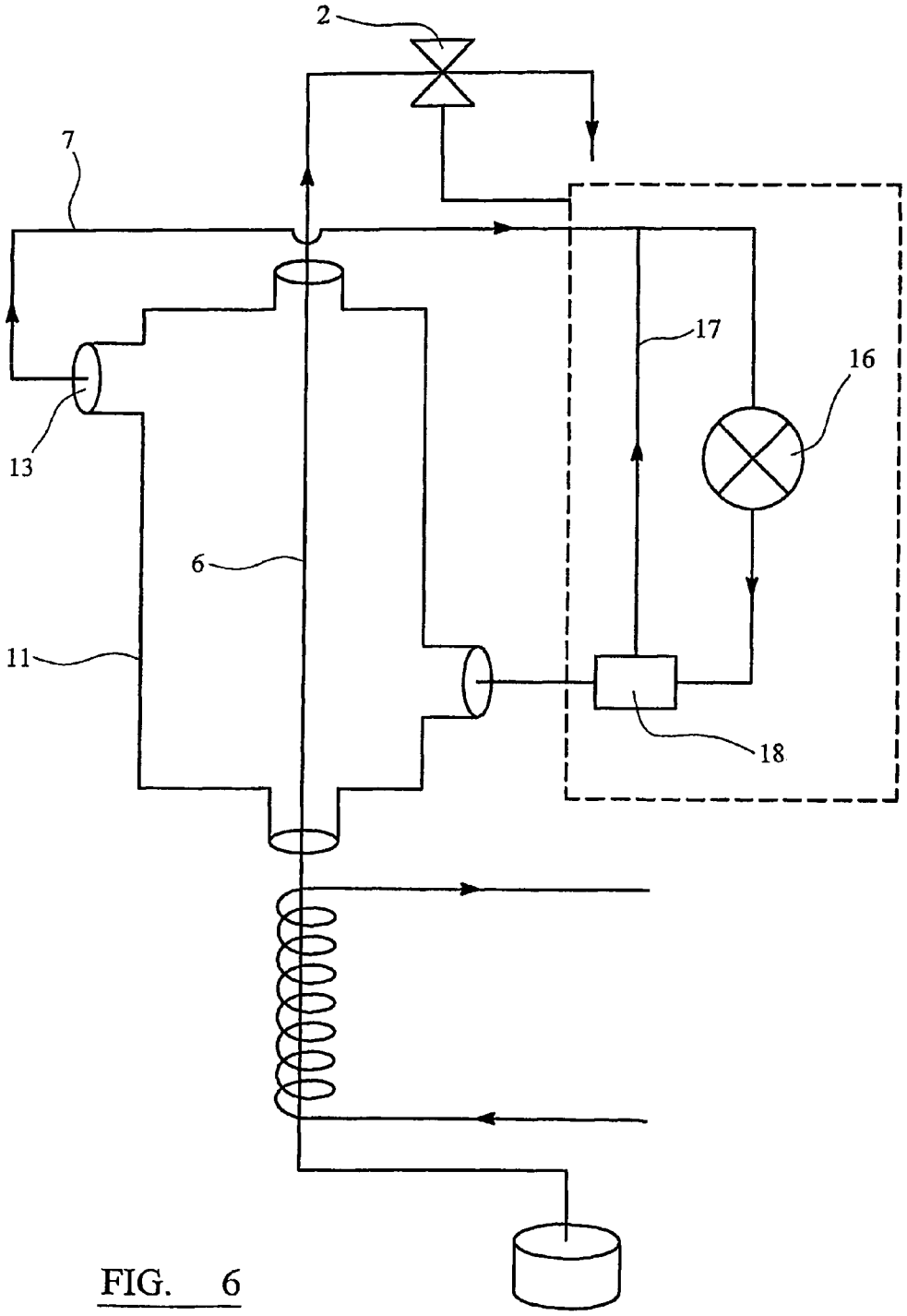
FIG. 6 shows a fifth embodiment of an apparatus according to the invention; and, FIG. 7 shows a portion of a heat exchanger and heat exchanger jacket of an embodiment of an apparatus according to the invention.

An apparatus 8 of a further embodiment of the invention is shown in FIG. 6. This apparatus 8 finds applications in the cooling of liquids in addition to liquid/gas mixtures. This apparatus 8 comprises only a single heat exchange tube 6. In use a liquid flows through the heat exchange tube 6. A heat exchange fluid 7 flows over the heat exchange tube 6 and is removed from the heat exchange jacket 11 if the flow of the liquid drops below a reference level. The heat exchange fluid 7 is reintroduced into the heat exchange jacket 11 when flow increases above the reference level.

The liquid or liquid could comprise a beer or lager as previously described. It could also comprise other alcoholic beverages such as spirits or vodka.

Preferably, the temperate of the heat exchange fluid 7 is lower than the freezing point of the liquid and the heat exchange fluid 7 is removed from the heat exchange jacket 11 to prevent freezing of the liquid in the heat exchange tube 6. In a preferred embodiment the liquid is super cooled when served such that it freezes on contact with a serving vessel.

An alternative embodiment of the apparatus of FIG. 6 comprises a plurality of heat exchange tubes 6.

Figure 7:
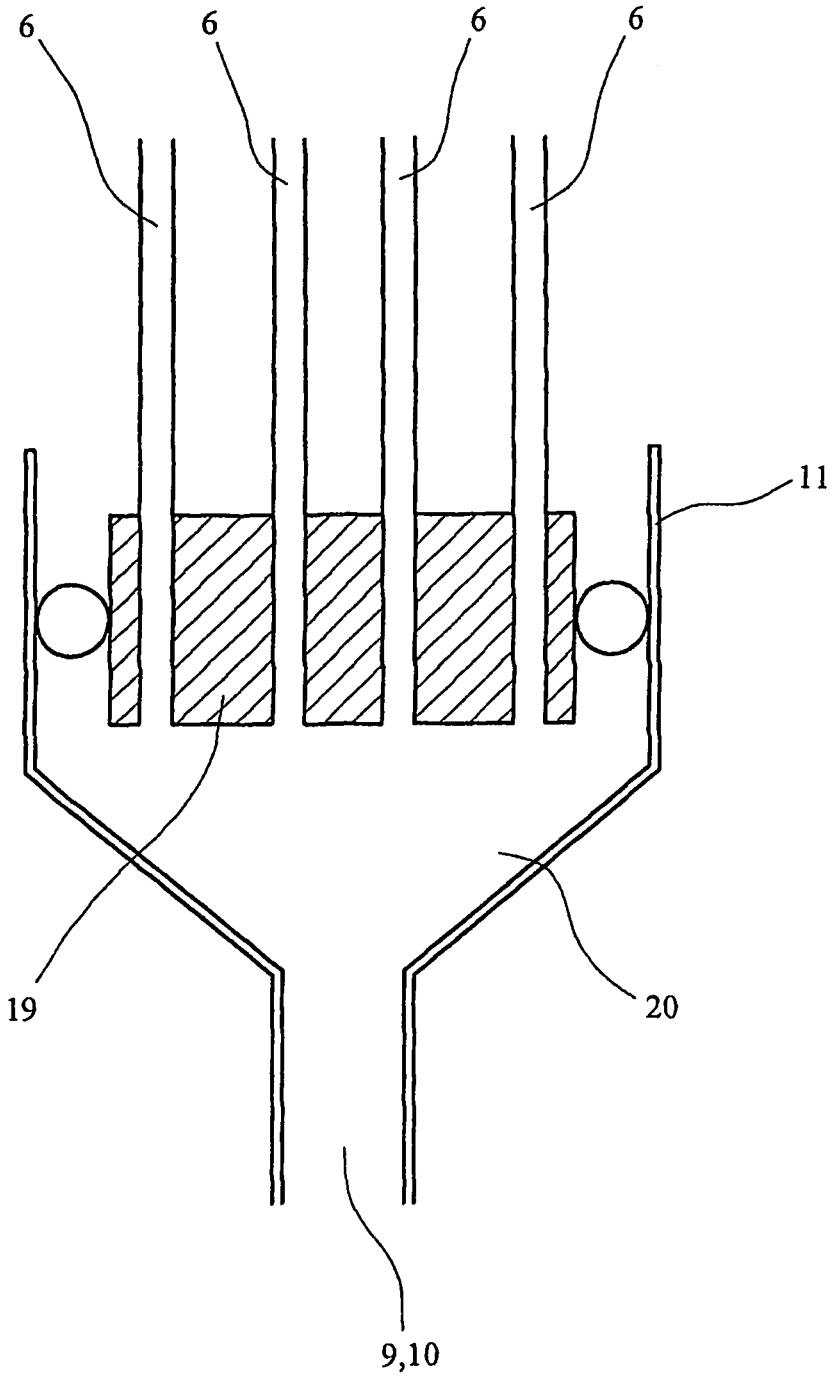

FIG. 7 shows a portion of a heat exchanger 4 and heat exchange jacket 11 of an apparatus 8 according to the invention. The plurality of heat exchange tubes 6 are laser welded into contact with the end stop 19. The end stop 19 is received within the heat exchange jacket 11. A fluid input port 9 (or output port 10 as the device is symmetric) extends through the heat exchange jacket 11 and is in fluid communication with the heat exchange tubes 6. The input/output port 9, 10 expands into chamber 20. The mixture recombines in chamber 20 before exiting through output port 10.

The invention claimed is:

1. A method of cooling a mixture, the mixture comprising a liquid having a gas dissolved therein, the method comprising the steps of:

providing the mixture along an input mixture line;

splitting the mixture from the input mixture line into a plurality of heat exchange tubes;

flowing a heat exchange fluid over the outside of the heat exchange tubes to cool the mixture; and re-combining the mixture into an output mixture line, characterized in that the temperature of the heat exchange fluid is arranged such that the temperature of the mixture at the point of recombination in the output mixture line is at or below the solution temperature of the gas in the liquid and in that the diameter of the tubes is less than the diameter of input and output ports of a heat exchanger that includes the heat exchange tubes.

2. A method as claimed in claim 1, further comprising the step of providing the cooled mixture to a dispensing means for dispensing the cooled mixture at a dispensing rate.

3. A method as claimed in claim 2, further comprising the step of warming the mixture in the output mixture line.

4. A method as claimed in claim 1, wherein the heat exchange tubes are spiral.

5. A method as claimed in claim 1, wherein the liquid is a beverage.

6. A method as claimed in claim 5, wherein the liquid is a beer or lager.

7. A method as claimed in claim 1, wherein the mixture is recombined at a temperature less than 4° C.

8. A method as claimed in claim 1, further comprising the step of pre-cooling the mixture before providing the mixture to the heat exchange tubes.

9. A method as claimed in claim 1, wherein the step of flowing a heat exchange fluid over the outside of the heat exchange tubes comprises:

measuring the flow rate of the mixture through the heat exchange tubes; and, flowing the heat exchange fluid over the heat exchange tubes when the flow rate exceeds a predetermined value.

10. A method as claimed in claim 9, wherein the heat exchange tubes are arranged in a heat exchange jacket through which the heat exchange fluid flows; and, the step of flowing the heat exchange fluid over the outside of the heat exchange tubes comprises the step of withdrawing the heat exchange fluid from the heat exchange jacket when the flow rate is at or below a predetermined value.

11. A method as claimed in claim 9, wherein the step of measuring the flow rate of the mixture comprises determining if the dispensing means is in an open or closed state.

12. An apparatus for cooling a mixture comprising a liquid having a gas dissolved therein, the apparatus comprising:

a heat exchanger comprising an input mixture port, an output mixture port and a plurality of heat exchange tubes extending therebetween;

a heat exchange jacket surrounding the heat exchange tubes and having input and output ports; and cooling means adapted to flow a heat exchange fluid into the input port, over the heat exchange tubes and out the output port to cool the mixture within the heat exchange tubes;

wherein the cooling means is adapted to flow the heat exchange fluid at a temperature sufficiently low that the temperature of the mixture at the output mixture port is at or below the solution temperature of the gas in the liquid.

13. An apparatus as claimed in claim 12, wherein the diameter of the tubes is less than the diameter of the input and output ports.

14. An apparatus as claimed in claim 12, further comprising a dispensing means for dispensing the cooled mixture at a dispensing rate.

15. An apparatus as claimed in claim 12, wherein the heat exchange tubes are spirals.

16. An apparatus as claimed in claim 12, wherein the heat exchange tubes are connected to the input and output mixture ports by laser welding.

17. An apparatus as claimed in claim 12, wherein the cooling means comprises a volume containing pre-cooled heat exchange fluid.

18. An apparatus as claimed in claim 12, wherein the cooling means comprises a heat exchange pump adapted to circulate the heat exchange fluid between the input and output ports.

19. An apparatus as claimed in claim 18, further comprising a flow rate detector for detecting the rate of flow of the mixture in at least one heat exchange tube, the flow rate detector being in communication with the heat exchange pump.

20. An apparatus as claimed in claim 19, wherein the heat exchange pump is adapted to provide heat exchange fluid to the heat exchange jacket only when the flow rate of the mixture in the at least one tube is above a reference level.

21. An apparatus as claimed in claim 19, wherein the heat exchange pump is adapted to withdraw the heat exchange fluid from the heat exchange jacket when the flow rate of the mixture is below a reference level.

22. An apparatus as claimed in claim 12, comprising a mixture source connected to the mixture input port by an input mixture line.

23. An apparatus as claimed in claim 22, further comprising a pre-cooling means for cooling the mixture before providing it to the input mixture port.

24. An apparatus as claimed in claim 23, wherein the pre-cooling means comprises a chilled volume.

25. An apparatus as claimed in claim 23, wherein the pre-cooling means comprises a python line wrapped around the input mixture line.

26. An apparatus as claimed in claim 18, wherein the heat exchange pump pumps heat exchange fluid through a python line and then through the heat exchange jacket.

27. An apparatus as claimed in claim 12, wherein the liquid of the mixture is a beverage.

28. An apparatus for cooling a liquid comprising:

a heat exchanger comprising an input liquid port, an output liquid port and at least one heat exchange tube extending therebetween;

a heat exchange jacket surrounding the at least one heat exchange tube having input and output ports;

a heat exchange pump connected between input and output ports and adapted to circulate heat exchange fluid therebetween;

a flow rate detector for detecting the rate of flow of liquid in the at least one heat exchange tube, the flow rate detector being in communication with the heat exchange pump;

the heat exchange pump being adapted to provide heat exchange fluid to the heat exchange jacket only when the flow rate of the liquid in the at least one heat exchange tube is above a reference level.

29. An apparatus as claimed in claim 28, wherein the reference level is zero.

30. An apparatus as claimed in claim 28, wherein the heat exchange pump is adapted to withdraw heat exchange fluid from the heat exchange jacket when the flow rate drops below the reference level.

31. An apparatus as claimed in claim 28, wherein the flow rate detector comprises a flow rate meter.

32. An apparatus as claimed in claim 28, wherein the flow rate detector is in communication with a tap, the tap being connected to the liquid output port for dispensing the liquid.

33. An apparatus as claimed in claim 32, wherein the tap communicates its on or off state to the heat exchange pump.

34. An apparatus as claimed in claim 28, further comprising a liquid source connected to the input liquid port.

35. An apparatus as claimed in claim 34, wherein the temperature of the heat exchange fluid is lower than the freezing temperature of the liquid.

36. An apparatus as claimed in claim 34, wherein the liquid is an alcoholic beverage.

37. An apparatus as claimed in claim 34, wherein the liquid is a beer or lager.

38. An apparatus as claimed in claim 28, wherein the apparatus comprises a plurality of heat exchange tubes.

39. An apparatus as claimed in claim 28, wherein the apparatus comprises a single heat exchange tube.

40. An apparatus as claimed in claim 28, wherein the heat exchange tubes are spiral.

* * * * *